US009259830B2

(12) United States Patent
Schad et al.

(10) Patent No.: US 9,259,830 B2
(45) Date of Patent: Feb. 16, 2016

(54) STRIKING MECHANISM AND HAND-HELD POWER TOOL

(75) Inventors: Hanspeter Schad, Grabs (CH); Christoph Hakenholt, Feldkirch (AT); Sherhey Khandozhko, Buchs (CH); Jochen Kuntner, Dornbirn (AT); Guenther Sanchen, Grabs (CH); Chafic Abu Antoun, Buchs (CH); Johann Dorfmeister, Feldkirch-Nofels (AT)

(73) Assignee: Hilti Aktiengesellschaft, Schaan (LI)

( * ) Notice: Subject to any disclaimer, the term of this patent is extended or adjusted under 35 U.S.C. 154(b) by 1330 days.

(21) Appl. No.: 12/657,311

(22) Filed: Jan. 19, 2010

(65) Prior Publication Data

US 2010/0206593 A1 Aug. 19, 2010

(30) Foreign Application Priority Data

Jan. 21, 2009 (DE) ..... 10 2009 000 363

(51) Int. Cl.
*B25D 11/06* (2006.01)

(52) U.S. Cl.
CPC ..... *B25D 11/064* (2013.01); *B25D 2250/345* (2013.01); *B25D 2250/371* (2013.01)

(58) Field of Classification Search
CPC ..... B25D 11/064; B25D 17/24; B25C 1/06; H02K 33/14
USPC ..... 173/114, 117, 202, 212, 128
See application file for complete search history.

(56) References Cited

U.S. PATENT DOCUMENTS

| | | | | |
|---|---|---|---|---|
| 2,892,140 | A | 6/1959 | Praeg | |
| 3,054,464 | A * | 9/1962 | Ondeck | 173/117 |
| 3,307,641 | A * | 3/1967 | Wiggins, Jr. | 175/56 |
| 3,924,789 | A * | 12/1975 | Avery et al. | 227/131 |
| 4,015,671 | A * | 4/1977 | Borisov et al. | 173/117 |
| 4,237,987 | A * | 12/1980 | Sherman | 173/117 |
| 5,778,673 | A | 7/1998 | Poertzgen | |
| 6,095,541 | A * | 8/2000 | Turner et al. | 280/276 |
| 6,520,269 | B2 * | 2/2003 | Geiger et al. | 173/117 |
| 7,025,183 | B2 | 4/2006 | Steffen et al. | |

(Continued)

FOREIGN PATENT DOCUMENTS

| | | |
|---|---|---|
| BE | 403 250 A | 5/1934 |
| CN | 1625458 | 6/2005 |
| DE | 6 05 529 | 6/1935 |

(Continued)

OTHER PUBLICATIONS

EPO machine translation of FR 2 240 797 (4 pages), Mar. 1975.

(Continued)

*Primary Examiner* — Andrew M Tecco
(74) *Attorney, Agent, or Firm* — Davidson, Davidson & Kappel, LLC

(57) ABSTRACT

A striking mechanism includes a working space whose first section is surrounded by a first electromagnet and whose second section is surrounded by a second electromagnet; a striking element that can move along a striking axis inside the working space and that has a magnetizable material; an anvil whose striking surface delimits the working space in the striking direction and which protrudes into the first magnetic coil and which is made of a magnetically soft material. A spring element is provided which exerts a force onto the striking element in every position in the working space in the direction of the anvil.

20 Claims, 3 Drawing Sheets

(56) References Cited

U.S. PATENT DOCUMENTS

| | | | | |
|---|---|---|---|---|
| 7,527,107 | B2 * | 5/2009 | Berger et al. | 173/162.2 |
| 2008/0202783 | A1 * | 8/2008 | Schaer et al. | 173/117 |

FOREIGN PATENT DOCUMENTS

| | | | |
|---|---|---|---|
| DE | 16 51 793 | | 3/1953 |
| DE | 11 06 707 | | 5/1961 |
| DE | 10 2007 000386 | A1 | 1/2009 |
| EP | 1 016 503 | A2 | 7/2000 |
| EP | 1 157 789 | A1 | 11/2001 |
| EP | 1 958 733 | A2 | 8/2008 |
| FR | 2 240 797 | A1 | 3/1975 |
| FR | 2 252 178 | A1 | 6/1975 |
| FR | 2 430 827 | A1 | 2/1980 |
| GB | 2 58 725 | | 9/1926 |
| GB | 589816 | | 7/1947 |
| JP | 9013869 | | 1/1997 |
| JP | 9118219 | | 5/1997 |

OTHER PUBLICATIONS

EPO machine translation of FR 2 430 827, Feb. 1980.
EPO machine translation of FR 2 252 178 (4 pages), Jun. 1975.
EPO machine translation of BE 403 250 (3 pages), May 1934.

* cited by examiner

STRIKING MECHANISM AND HAND-HELD POWER TOOL

This claims the benefit of German Patent Application DE 10 2009 000363.0-15, filed Jan. 21, 2009, and hereby incorporated by reference herein.

The invention relates to a striking mechanism and to a striking power tool having a striking mechanism.

BACKGROUND

Even though striking mechanisms have been known since the beginning of the 20$^{th}$ century, such as the striking mechanism having two magnetic coils described in U.S. Pat. No. 2,892,140, so far their striking power has been inferior to the striking power of other striking mechanism of a different type known at that time.

The striking mechanisms based on the direct acceleration of a striking element by means of magnetic fields have the advantage of a greater degree of control of the striking behavior, especially the possibility of immediately switching off the striking mechanism.

SUMMARY OF THE INVENTION

An object of the present invention is to provide a striking mechanism based on two magnetic coils having a greater striking force.

The striking mechanism according to the invention includes a working space whose first section is surrounded by a first electromagnet and whose second section is surrounded by a second electromagnet, a striking element that can move along a striking axis inside the working space and that has a magnetizable material, and an anvil whose striking surface delimits the working space in the striking direction. A spring element is provided which exerts a force on the striking element in every position in the working space in the direction of the anvil. The spring element is correspondingly biased during the movement away from the anvil.

The striking element rebounds from the anvil and retains some of its kinetic energy. With the return movement, the energy is transferred to the spring element and stored. During the next forward movement in the direction of the anvil, in addition to the forces that are already active due to the magnetic fields, also the spring element accelerates the striking element. This translates into a more efficient utilization of the energy contained in the system.

The spring element is preferably configured in such a way that the spring force drops to zero when the striking element strikes the striking surface.

According to an embodiment, the spring element is a mechanical spring or an air spring. The air spring can be formed by a pneumatic space. This pneumatic space can be formed by a section of the working space that is delimited with respect to the anvil by the striking element.

The spring element can have a progressive characteristic curve in which the spring constant rises opposite to the striking direction. The tractive force that the second electromagnet can exert upon the striking element rises as the distance decreases between the striking element and the reversal point facing away from the striking surface. The rising characteristic curve opposite to the striking direction brings about an efficient utilization of this rising force.

One embodiment provides that the anvil protrudes into the first electromagnet and is made of a magnetically soft material, and that the diameter of the striking element and the diameter of the anvil differ by less than 20%, preferably by less than 10%. The similar or equal cross sections of the striking element and of the striking surface of the anvil cause the field lines to run essentially only from the striking element to the striking surface, without traversing unnecessary distances in the air. It is assumed that this makes it possible to generate higher forces to accelerate the striking element through the magnetic field.

One embodiment provides that the anvil protrudes into the first magnetic coil or into the first electromagnet for at least a certain distance that is greater than the deflection of the anvil during the impact with the striking element. The distance can also be, for instance, at least one-tenth of the length of the magnetic coil in the magnetic coil. Preferably, the anvil moves into the first electromagnet to such a depth that at least half of the magnetic flux of the first electromagnet flows sideways into the anvil, after which it then leaves the striking surface.

One embodiment provides that the electromagnet has a magnetic coil and a magnetic field guide, whereby the magnetic field guide surrounds the outside of the magnetic coil. Preferably, the magnetic field guide borders on the anvil.

One embodiment provides that the working space is delimited on a side facing away from the anvil by a stop that protrudes into the second magnetic coil and that is made of a magnetically soft material.

According to one embodiment, the first or the second magnetic coil has a certain length and winding thickness, whereby the ratio of length to winding thickness is less than 1.25. This optimizes the ratio of ohmic loss to the acceleration work performed by the magnetic coils.

According to one embodiment, the surface of the striking element has lengthwise grooves or holes that pass through the striking element.

A power tool according to the invention, especially a hand-held power tool, has the striking mechanism according to the invention.

BRIEF DESCRIPTION OF THE DRAWINGS

The description that follows explains the invention on the basis of embodiments shown by way of an example and on the basis of figures, which show the following.

Unless otherwise indicated, identical or functionally equivalent elements are designated by the same reference numeral in the figures.

DETAILED DESCRIPTION

Figure 1:
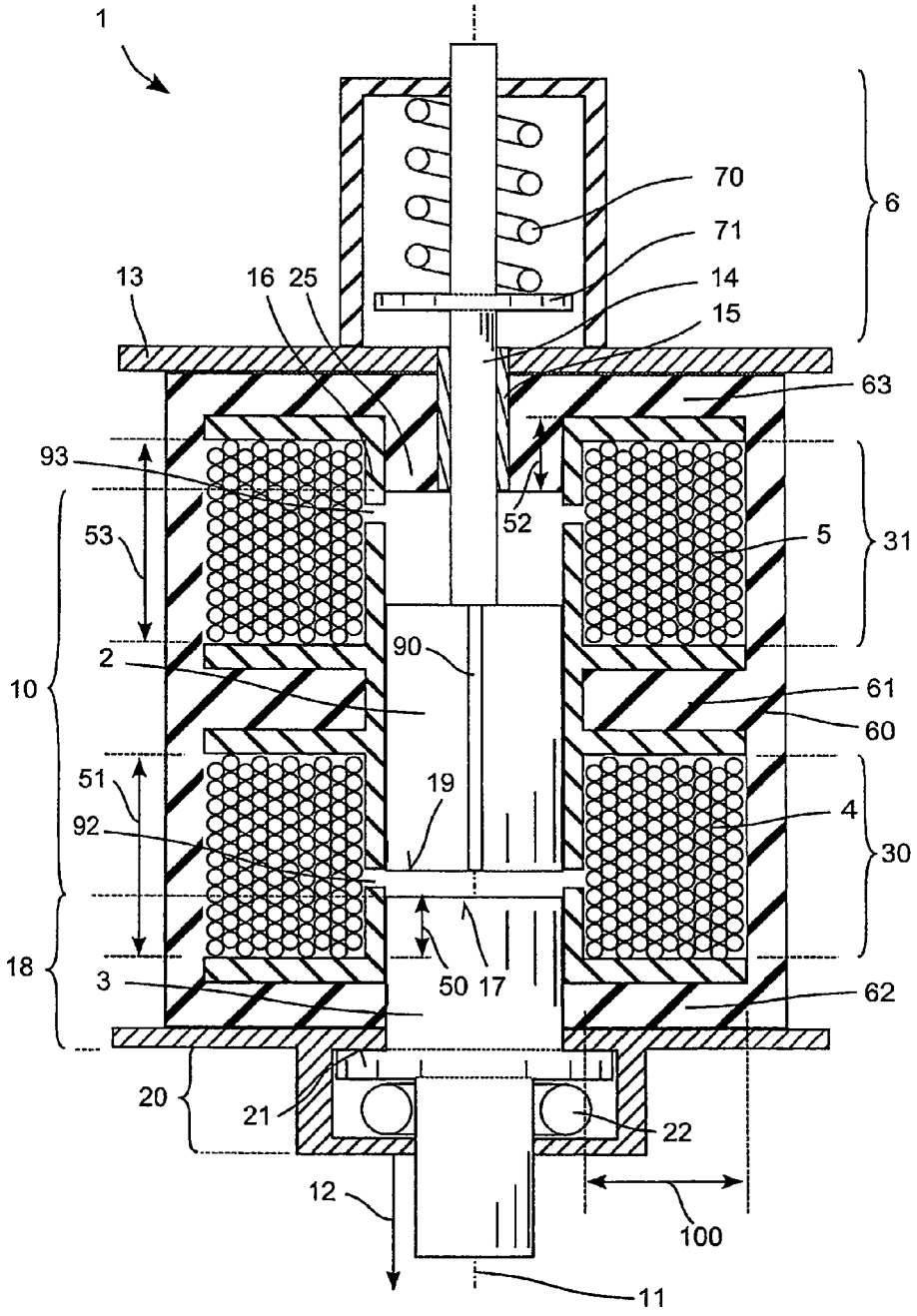
FIG. 1—a partial cross section of a striking mechanism.

FIG. 1 shows a partial section of an embodiment of a striking mechanism 1. The striking mechanism 1 has a striking group having a striking element 2 and an anvil 3, a primary drive with magnetic coils 4, 5 and an energy buffer with a spring element 6.

The striking element 2 is arranged in a working space 10 so that it can move along a striking axis 11. The working space 10 is delimited in the striking direction 12 by the anvil 3. Opposite to the striking direction 12, a housing 13 delimits the working space 10.

The striking element 2 can be guided in the working space 10 by a rod 14 along a striking axis 11. The rod 14 is firmly joined to the striking element 2 and guided, for instance, by a bearing 15 on the housing 13. The working space 10 can be laterally delimited by a sleeve 16 that additionally guides the striking element 2.

Along the striking axis 11, the working space 10 exhibits a constant cross-sectional surface area that is adapted to the dimensions of the striking element 2. The cross-sectional surface area of the striking element 2 can be just slightly smaller so that movement is still possible. For example, the working space 10 and the striking element 2 are cylindrical.

The anvil 3 has a striking surface 17. This striking surface 17 is formed by an end piece 18 having an essentially constant cross section, for instance, a cylindrical cross section. The cross-sectional surface area of the end piece 18 and thus also that of the striking surface 17 are preferably the same size as the cross-sectional surface area of the striking element 2.

In a special embodiment, the striking surface 17 of the anvil as well as the corresponding striking surface 19 of the striking element 2 create a positive fit with each other. In one variant, both striking surfaces 17, 19 are planar. As an alternative, one of the two striking surfaces 17, 19 can be convex, whereby the other one of the striking surfaces 19, 17 is correspondingly concave.

The anvil 3 is mounted in a guide 20. This guide 20 has a stop 21 opposite to the striking direction 12. A recovery element 22, for instance, a damping ring or a return spring, presses the anvil 3 opposite to the striking direction 12 against the stop 21. As a result, following a deflection in the striking direction 12 and due to an impact with the striking element 2, the anvil 3 once again reaches a defined starting position.

A stop 25 that delimits the working space 10 is provided on the side of the working space 10 facing away from the anvil 3. The stop 25 can be formed by the housing 13.

The working space 10 is surrounded by at least two magnetic coils 4, 5. These two magnetic coils 4, 5 are arranged offset relative to each other along the striking axis 11. The first magnetic coil 4 covers a first section 30 of the working space 10 and the end piece of the anvil 3. The second magnetic coil 5 covers a second section 31 of the working space 10 and the stop 25.

The two magnetic coils 4, 5 are connected to a power source. A control unit allows current to flow through the two magnetic coils 4, 5 alternately. As a consequence, a magnetic field flows through the first section 30 and the second section 31 of the working space 10 alternately.

The striking element 2 is made of a magnetic material or it has inserts made of a magnetic material. The appertaining magnetic field acts upon the striking element 2 and accelerates said striking element 2.

The anvil 3 is made of a magnetic material. This anvil 3 functions like a pole shoe. The magnetic field in the first section 30 exits the anvil 3 vertically. The forces on the striking element 2 act correspondingly parallel to the direction of movement of the striking element 2, that is to say, parallel to the striking axis.

The magnetic, for example, ferromagnetic, material of the anvil 3 preferably loses its magnetization when no magnetic field is present in the first section 30. In a corresponding manner, the anvil 3 is preferably made of a magnetically soft material having a low coercivity field strength of less than 1000 A/m.

Owing to the at least partial positive fit between the striking surfaces 17, 19 of the striking element 2 and anvil 3, the magnetic field flows largely directly between the two striking surfaces 17, 19. This minimizes the magnetic flux that has to flow over a longer distance than the distance between the striking element 2 and the anvil 3. This is particularly valuable because the magnetic force rises as the distance between the striking surfaces 17, 19 diminishes.

The shape and curvature of the striking surface 17 of the anvil 3 can be adapted in such a way as to optimize the exit of the magnetic field via the striking surface 17.

The end piece 18 of the anvil 3 protrudes into the first magnetic coil 4 for at least a distance 50, which is greater than the path traversed by the anvil 3 during a strike. Moreover, the distance 50 can amount to between one-tenth and one-fourth of the length 51 of the first magnetic coil 4, for instance, at least one-sixth or at the maximum one-sixth.

The stop 25 is likewise made of a magnetic material, for instance, a ferromagnetic material. The design of the stop 25 can be the same as the above-mentioned designs of the anvil 3. The depth 52 by which the stop 25 protrudes into the second magnetic coil 5 can amount to between one-tenth and one-fourth of the length 53 of the second magnetic coil 5. In one embodiment, however, the rest of the design of the stop 25 and anvil 3 can differ.

A magnetic field guide 60 can surround the magnetic coils 4, 5 from the outside. The magnetic field guide 60 is made of magnetically soft material, for example, sheet iron. The magnetic field guide 60 can have a ridge 61 that is located between the two magnetic coils 4, 5 and that borders on the working space 10. Preferably, an outer ridge 62 on the first magnetic coil 4 pupil extends all the way to the anvil 3 in order to conduct the magnetic field into the anvil 3. By the same token, another ridge 63 can be in contact with the stop 25 or can form the stop 25.

The spring element 6 can have, for instance, a spiral spring 70 or some other mechanical spring. The rod 14 has a projection or a disk 71 that engages into the spiral spring 70. The spring path of the spiral spring 70 is configured in such a way that the striking element 2 is pressed by the spiral spring 70 in the striking direction 12 while in any position inside the working space 10. A spring constant of the spiral spring 70 is preferably configured in such a way that any movement of the striking element 2 is completely braked when the striking element 2 is bordering on the stop 25. As a result, it is avoided that the striking element 2 mechanically strikes the housing 13.

The spring constant of the spring element 6 preferably increases as the compression of the spring element 6 rises. The dependence of the spring constant on the position of the striking element 2 can be selected so as to be adapted to the dependence of the tractive force of the second magnetic coil 5 on the position of the striking element 2, for example, both dependences are proportional to each other. This efficiently utilizes the work that the second magnetic coil 5 is able to perform. As an alternative, the spring element 6 can have a linear characteristic curve, in other words, a spring constant that is not dependent on the compression of the spring 6.

The striking element 2 can have grooves 90 on its surface. These grooves 90 serve to allow an air exchange between the stop 25 and the anvil 3 during the movement of the striking element 2. Instead of or in addition to the grooves 90, there can also be holes in the striking element 2.

Another embodiment provides for a ventilation system in which ventilation openings 92, 93 lead into the first and second sections 30, 31 of the working space 10. The ventilation openings 92, 93 can be connected to each other via a channel system or else they can be connected to the environment.

Figure 2:
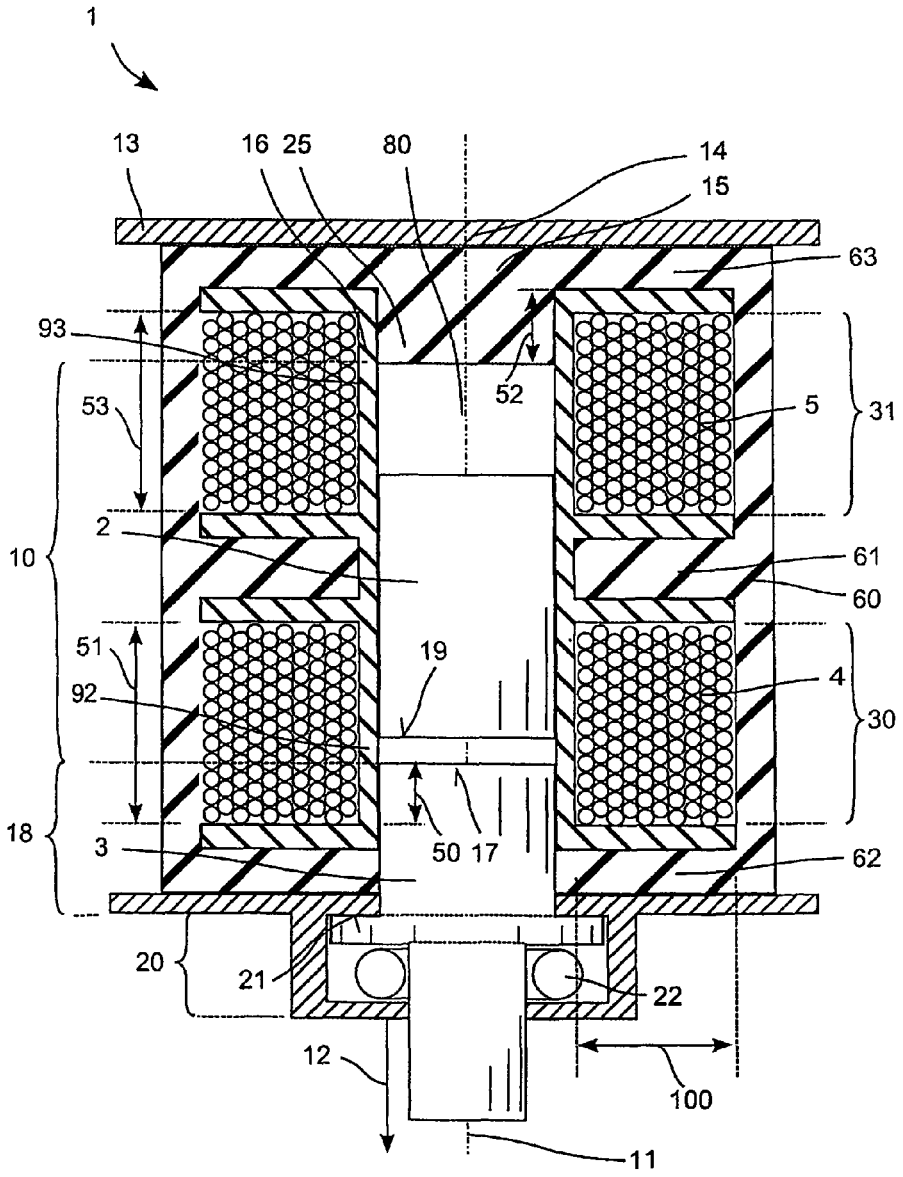
FIG. 2—a partial cross section of another striking mechanism.

Instead of or in addition to the spiral spring 70, it is also possible to employ an air spring. FIG. 2 shows an embodiment of a striking mechanism 1 in which there is a pneumatic space 80 inside the working space 10. This pneumatic space 80 is delimited pressure-tight by the striking element 2, the stop 25 and the sleeve 16. When the striking element 2 moves opposite to the striking direction, the pneumatic space 80 is compressed. As soon as the kinetic energy of the striking element 2 has been completely converted into compression work of the pneumatic space 80, the reversal movement in the striking direction 12 begins. The pneumatic space can also be located outside of the working space 10 and coupled by the rod 14.

The magnetic coils 4, 5 are manufactured in the conventional manner, for example, making use of a wound, coated wire. The length 51, 53 of the magnetic coils 4, 5 is at the maximum 30% greater than a winding height 100 of the magnetic coils 4, 5. The acceleration work per distance of the striking element 2 that has been travelled is not constant owing to the non-linear characteristic curve of the force, but rather, increases as the distance to the anvil 3 or stop 25 diminishes. Therefore, a longer magnetic coil 4, 5 only brings about slightly greater acceleration work. The ohmic power dissipation of the magnetic coils 4, 5, in contrast, is proportional to their length 51. Consequently, it seems advantageous to employ short magnetic coils 4, 5.

The striking element 2 can be made of a ferromagnetic material having a high coercivity field strength (>1000 A/m). Thus, the striking element 2 remains permanently magnetized. The polarity of the magnetic fields generated by the magnetic coils 4, 5 should be set as a function of the polarization direction of the striking element 2. Moreover, the polarity of the magnetic coils 4, 5 can be turned during one movement cycle of the striking element 2 in order to apply a pulling as well as a pushing force on the striking element 2.

Figure 3:
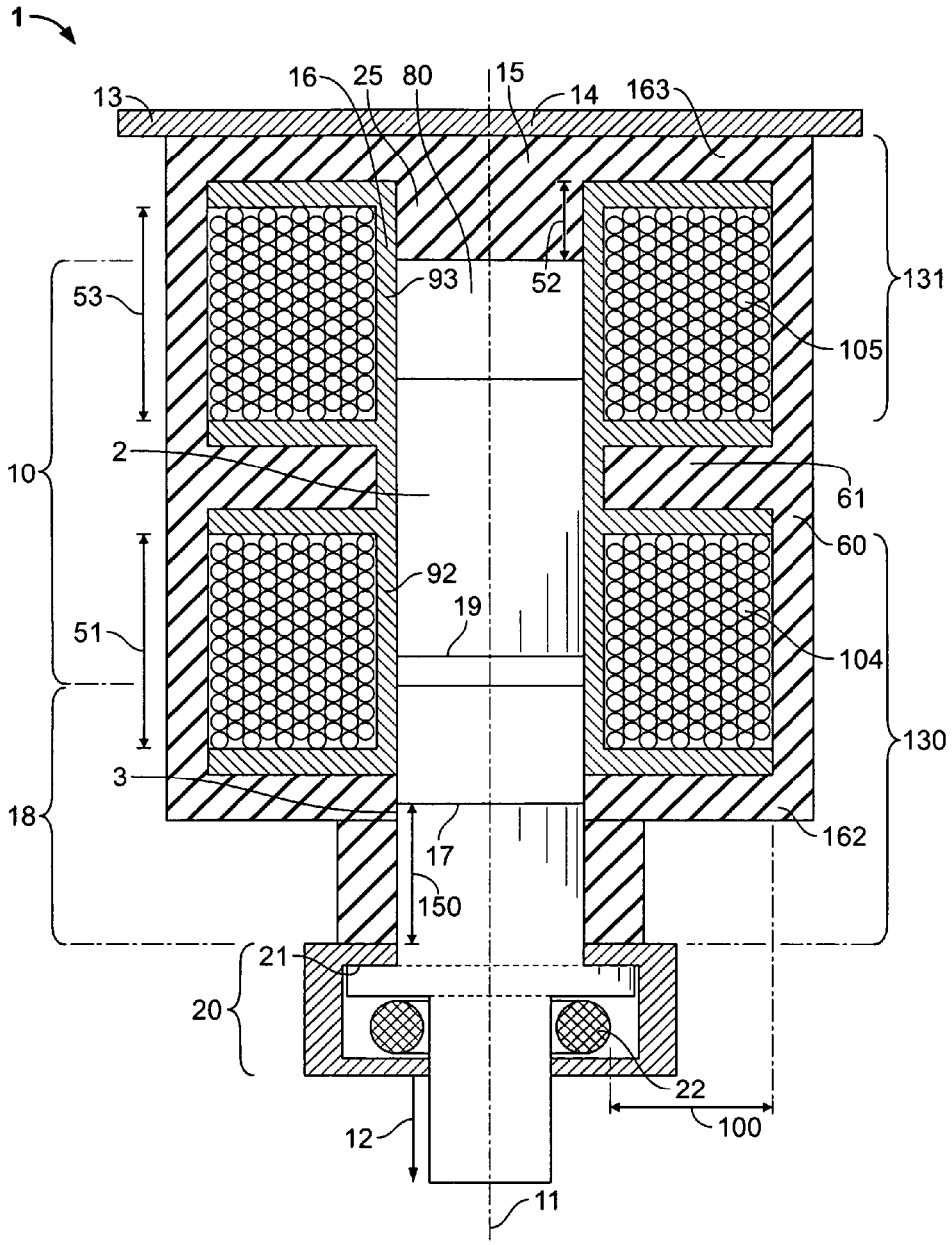
FIG. 3—a partial cross section of another striking mechanism.

FIG. 3 shows another embodiment of the striking mechanism 1. First and second magnetic coils 104, 105 are surrounded by a magnetic field guide 60, 162, 163 and respectively form a first and second electromagnet. The magnetic field guide 162 borders on the anvil 3. The magnetic field guide 162 can extend along the striking axis 11 by a distance that is comparable to the length 51 of the first magnetic coil 104. For instance, the distance amounts to one-third to one-half of the length 51 of the first magnetic coil 104. The magnetic field guide 162 borders on the striking space along the entire distance. The armature 3 penetrates into the first electromagnet by a depth 150, in other words, it penetrates the magnetic field guide 162. This depth 150 is preferably selected in such a way that at least half of the magnetic flux flows out of the magnetic coil 104 through the anvil 3.

What is claimed is:

1. A striking mechanism having a working space whose first section is surrounded by a first electromagnet and whose second section is surrounded by a second electromagnet, and comprising:

a striking element moveable along a striking axis inside the working space and that has a magnetizable material;

an anvil whose striking surface delimits the working space in the striking direction; and a spring element exerting a force on the striking element in every position in the working space in a direction of the anvil.

2. The striking mechanism as recited in claim 1 wherein the spring element is a mechanical spring and/or an air spring.

3. The striking mechanism as recited in claim 2 wherein the spring is an air spring formed by a pneumatic space.

4. The striking mechanism as recited in claim 3 wherein the pneumatic space is formed by a section of the working space that is delimited with respect to the anvil by the striking element.

5. The striking mechanism as recited in claim 1 wherein the spring element has a progressive characteristic curve in which the spring constant rises opposite to the striking direction.

6. The striking mechanism as recited in claim 1 wherein the first electromagnet has a first magnetic coil and a first magnetic field guide surrounding an outside of the first magnetic coil, and the first magnetic field guide borders on the anvil, and/or the second electromagnet has a second magnetic coil and a second magnetic field guide surrounding an outside of the second magnetic coil, and the second magnetic field guide borders on the anvil.

7. The striking mechanism as recited in claim 6 wherein the anvil protrudes into the first magnetic coil.

8. The striking mechanism as recited in claim 6 wherein the anvil protrudes into the first electromagnet in such way that at least half of the magnetic flux of the first electromagnet flows through the anvil.

9. The striking mechanism as recited in claim 6 wherein first electromagnet has a length and the anvil protrudes into first electromagnet or into the first magnetic coil by at least one-tenth of the length of the first electromagnet.

10. The striking mechanism as recited in claim 6 wherein the first or the second magnetic coil has a certain length and winding thickness, a ratio of the certain length to the winding thickness being less than 1.25.

11. The striking mechanism as recited in claim 1 wherein the anvil protrudes into the first magnetic coil and is made of a magnetically soft material, and a diameter of a striking surface of the striking element and a further diameter of the a striking surface of the anvil differ by less than 20%.

12. The striking mechanism as recited in claim 11 wherein the anvil protrudes into the first electromagnet in such way that at least half of the magnetic flux of the first electromagnet flows through the anvil.

13. The striking mechanism as recited in claim 1 wherein the working space is delimited on a side facing away from the anvil by a stop protruding into a second magnetic coil of the second electromagnet and that is made of a magnetically soft material.

14. The striking mechanism as recited in claim 1 wherein the surface of the striking element has lengthwise grooves or holes passing through the striking element.

15. A power tool comprising a striking mechanism as recited in claim 1.

16. The striking mechanism as recited in claim 1 further comprising a housing delimiting the working space opposite the anvil, a bearing on the housing, and a rod joined to the striking element and guided by the bearing.

17. The striking mechanism as recited in claim 16 wherein the rod has projection, the spring element being a spiral spring surrounding the rod and engaging the projection.

18. The striking mechanism as recited in claim 1 further comprising a guide and a recovery element, the anvil being mounted in the guide, the recovery element pressing the anvil opposite the striking direction.

19. The striking mechanism as recited in claim 18 wherein the recovery element is a damping ring.

20. The striking mechanism as recited in claim 18 wherein the guide has a stop opposite to the striking direction, the recovery element pressing the anvil opposite the striking direction against the stop.

* * * * *